US006382201B1

(12) United States Patent
McPherson et al.

(10) Patent No.: US 6,382,201 B1
(45) **Date of Patent: *May 7, 2002**

(54) BOW VIBRATION DAMPER

(75) Inventors: Mathew A. McPherson, 19055 Incline Rd., Norwalk, WI (US) 54648; Gary I. Simonds, West Salem, WI (US)

(73) Assignee: Mathew A. McPherson, Norwalk, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/503,013

(22) Filed: Feb. 11, 2000

Related U.S. Application Data

(63) Continuation-in-part of application No. 09/441,827, filed on Nov. 17, 1999.

(51) Int. Cl.[7] ..... F41B 5/20
(52) U.S. Cl. ..... 124/89; 124/23.1
(58) Field of Search ..... 124/23.1, 25.6, 124/86, 88, 89

(56) References Cited

U.S. PATENT DOCUMENTS

| | | | | | |
|---|---|---|---|---|---|
| 3,342,172 | A | * | 9/1967 | Sanders | 124/89 X |
| 3,416,508 | A | | 12/1968 | Thompson | 124/24 |
| 3,670,712 | A | * | 6/1972 | Izuta | 124/89 |
| 3,841,295 | A | | 10/1974 | Hunter | 124/24 R |
| 3,854,467 | A | | 12/1974 | Hofmeister | 124/24 R |
| 3,958,551 | A | | 5/1976 | Ketchum | 124/24 R |
| 3,993,039 | A | | 11/1976 | Groves et al. | 124/23 |
| 4,372,285 | A | | 2/1983 | Simonds et al. | 124/90 |
| 4,401,097 | A | | 8/1983 | Simonds et al. | 124/23 R |
| 4,438,753 | A | | 3/1984 | Simonds | 124/24 R |
| 4,440,142 | A | | 4/1984 | Simonds | 124/23 R |
| 4,458,657 | A | | 7/1984 | Stockmar | 124/17 |
| 4,461,267 | A | | 7/1984 | Simonds et al. | 124/23 R |
| 4,478,203 | A | | 10/1984 | Hayes | 124/24 R |
| 4,512,326 | A | | 4/1985 | Jarrett | 124/23 R |
| 4,660,536 | A | | 4/1987 | McPherson | 124/24 R |
| 4,827,894 | A | | 5/1989 | Schallberger | 124/25 |
| 4,838,236 | A | | 6/1989 | Kudlacek | 124/23 R |
| 4,893,606 | A | * | 1/1990 | Sisko | 124/89 |
| 4,909,231 | A | | 3/1990 | Larson | 124/23 R |
| 4,993,399 | A | | 2/1991 | Chattin | 124/25.6 |
| 5,005,554 | A | | 4/1991 | Shepley et al. | 124/24.1 |
| 5,016,602 | A | | 5/1991 | Mizek | 124/89 |
| 5,040,520 | A | | 8/1991 | Nurney | 124/25.6 |
| D331,614 | S | | 12/1992 | Martin et al. | D22/107 |
| 5,174,268 | A | | 12/1992 | Martin et al. | 124/25.6 |
| 5,307,787 | A | | 5/1994 | LaBorde et al. | 124/25.6 |
| 5,339,793 | A | * | 8/1994 | Findley | 124/89 |
| 5,362,046 | A | | 11/1994 | Sims | 273/73 |

(List continued on next page.)

OTHER PUBLICATIONS

Digital images of pertinent portion of "Shooting Star" bow manufactured by Jennings Archery, approx. 1978.
Bow & Arrow publication of Apr. 1980.
Bow & Arrow publication Dec. 1975.
Advertising from Allen, The Original Compound Bow, Dec. 1975.
Dynabo (Models M–10 Cheetah & Jim Cox Magnum) Instruction Manual Excerpt, mid–1970's.
KAM–ACT "MK–2" Instruction Manual Excerpt, early 1970's.

(List continued on next page.)

*Primary Examiner*—John A. Ricci
(74) *Attorney, Agent, or Firm*—Vidas, Arrett & Steinkraus, P.A.

(57) ABSTRACT

A dampening device for an archery bow, the dampening device absorbing vibrational energy as the limbs of the bow return to a rest position from a drawn position, the dampening device comprising at least one counterweight mounted to a resilient member. The resilient member mounted to a dampening device mounting region located on a portion of the bow or bow accessory.

43 Claims, 16 Drawing Sheets

U.S. PATENT DOCUMENTS

| | | | | | |
|---|---|---|---|---|---|
| 5,368,006 | A | | 11/1994 | McPherson | 124/25.6 |
| 5,370,104 | A | * | 12/1994 | Neie | 124/89 |
| 5,411,009 | A | | 5/1995 | Thompson et al. | 124/89 |
| 5,495,843 | A | | 3/1996 | Larson | 124/25.6 |
| 5,505,185 | A | | 4/1996 | Miller | 124/25.6 |
| 5,515,836 | A | | 5/1996 | Martin et al. | 124/23.1 |
| 5,595,168 | A | | 1/1997 | Martin | 124/89 |
| 5,638,804 | A | | 6/1997 | Remick et al. | 124/25.6 |
| 5,678,529 | A | | 10/1997 | Larson | 124/25.6 |
| 5,735,257 | A | * | 4/1998 | Walk | 124/89 |
| 5,762,060 | A | | 6/1998 | Larson | 124/88 |
| 5,782,229 | A | | 7/1998 | Evans et al. | 124/25.6 |
| 5,809,982 | A | | 9/1998 | McPherson | 124/25.6 |
| 5,934,265 | A | | 8/1999 | Darlington | 124/25.6 |
| 5,937,843 | A | * | 8/1999 | Troncoso | 124/89 |
| 6,105,564 | A | * | 8/2000 | Suppan | 124/89 X |

OTHER PUBLICATIONS

KAM–ACT Instruction Manual Excerpt for Martin Archery, Inc., "New for '74", mid–1970's.
Ben Pearson Archery advertisement.
Hoyt Archery advertisement.
Browning advertisement.

* cited by examiner

BOW VIBRATION DAMPER

CROSS-REFERENCE TO RELATED APPLICATIONS

This is a continuation in part application of U.S. patent application Ser. No. 09/441827, filed Nov. 17, 1999 now U.S. Pat. No. 6,257,220, entitled "Bow Handle Damper", the entire contents of which are hereby incorporated by reference.

STATEMENT REGARDING FEDERALLY SPONSORED RESEARCH

Not Applicable

BACKGROUND OF THE INVENTION

This invention relates to archery bows and accessories thereof, and more particularly to a damping device or devices to be incorporated into or attached to the bow handle, risers limbs, limb cups or accessories to absorb excess energy thereby reducing hand shock, noise and bow vibration, which makes the bow smother and quieter to shoot.

Everyone is familiar with the archery bow and arrow. The bow is a simple mechanical device used to store energy derived from the archer during the drawing of the bow and then when the archer looses the bow string the bows energy is rapidly released. The greater portion of this energy goes into the launching of the arrow and most of the remainder finds its way back into the bow with the excess resulting in noise or is simply lost in the transfer process. Some of the energy that goes back into the bow returns it to its original undrawn state but much of it goes into excessive movement of various bow components resulting in bow hand shock and system vibrations.

Over the years archery manufactures have attempted to make the bow more efficient, and in some ways they have succeeded. The compound bow is an example of the modern manufactures success in being able to increase the amount of energy that a bow can store. Some modem compound bows store almost 50% more energy per peak pound of draw weight than the longbows of years past. The basic premise being that the more energy stored the more energy one has available to launch the arrow and the result will be greater and greater arrow launch velocities. To some extent this has become true and arrow initial velocities for bow hunters have increased over the last couple of decades. Along with bows that are capable of storing energy more efficiently, the quest for higher arrow velocities has been further augmented by the fact that lighter mass weight arrows have greater launch velocities than do heavier mass weight arrows. Arrow manufactures in the last two decades have taken advantage of the availability of higher strength materials and made lighter and lighter mass weight arrows available.

The result is that today's bows are storing more energy and are being used to launch lighter and lighter weight arrows. The problem arises from the fact that the amount of energy that a given bow can transfer to an arrow is directly proportional to the weight of the arrow being shot. The overall mechanical efficiency of the bow is determined in the usual fashion in that we look at the ratio of the energy coming out of the system divided by the energy that was put into the system. In this case we have the kinetic energy in the arrow at launch divided by the energy put into the bow by the archer prior to arrow launch. In this manner it is easily verifiable that bows in general can have efficiencies of nearly 90% when shooting very heavy weight arrows and the same bow can exhibit efficiencies in the lower 60 percentile when shooting very light weight arrows. The result is that a bow shooting heavy weight arrows imparts most of its stored energy to the arrow and after launch the bow must absorb only 10% of the original stored energy. On the other hand if the same bow were to shoot very light weight arrows it would have to absorb up to 40% of the original stored energy after each launch.

A number of the compound bows being offered today can store as much as 100 foot pounds of energy, therefore it is conceivable that such a bow shooting a very light weight arrow could have to absorb up to almost 40 foot pounds of energy after each arrow launch. This excess energy trapped in the bow often results in a great deal of bow shock and vibration which is not only unpleasant to the archer but also takes its toll on the bows components and the accessories mounted to the bow.

Some manufactures have tried to address the problem of this residual energy by using after market shock absorbing stabilizers and several patents have been issued for such devices (e.g. U.S. Pat. Nos. 5,016,602 and 5,411,009). These devices tend to be effective only along the axis on which they are mounted and the degree of damping that they provide is generally proportional to the amount of weight that they add to the system. The proposed damper is designed to be multi-axial in its ability to absorb and dissipate excess energy and in comparison it adds much less weight making it much more effective than previous dampers.

Other inventions which may be utilized with, or which may be otherwise relevant to, the present invention are disclosed in the following concurrently filed and commonly assigned applications: U.S. Application entitled IMPROVED ELASTICALLY MOUNTED COUNTER WEIGHT, application Ser. No. 09/502149, filed Feb. 11, 2000; U.S. Application entitled DUAL FEED PIVOTING FEED-OUT, application Ser. No. 09/502643, filed Feb. 11, 2000; U.S. Application entitled ROUND WHEEL CAM, application Ser. No. 09/502354, filed Feb. 11, 2000; U.S. Application entitled ARCHERY BOW WITH BOW STRING COPLANAR WITH THE LONGITUDINAL AXIS OF THE BOW HANDLE, application Ser. No. 09/502917, filed Feb. 11, 2000; and U.S. Application entitled LEVEL NOCKING POINT TRAVEL CAM application Ser. No. 09/502152, filed Feb. 11, 2000.

All of the references contained herein, including the co-pending Applications listed above, are respectively incorporated in their entirety herein by reference.

BRIEF SUMMARY OF THE INVENTION

The present invention is directed to a damper for reducing or dissipating energy. Specifically, the present invention addresses the problem of the excess energy that the bow is unable to transfer to the arrow during each shot by providing the bow with one or more energy-absorbing dampers. The present damper may be designed to be retrofitted to or be originally equipped upon any part of the handle, risers, limbs, limb cups, or other parts of the bow. The present damper may dissipate 20% or more of the excess energy created by the recoil of a the bow during and subsequent to shooting of the bow. This dissipation of energy reduces vibration making the shooting of the bow more pleasant and resulting in a quieter bow with less damage to bow components and accessories. One or more of the present dampers may be incorporated or retrofitted to any type of bow including modern compound bows, recurve bows, long bow, and even cross-bows.

BRIEF DESCRIPTION OF THE SEVERAL VIEWS OF THE DRAWINGS

A detailed description of the invention is hereafter described with specific reference being made to the drawings in which.

DETAILED DESCRIPTION OF THE INVENTION

Figure 1:
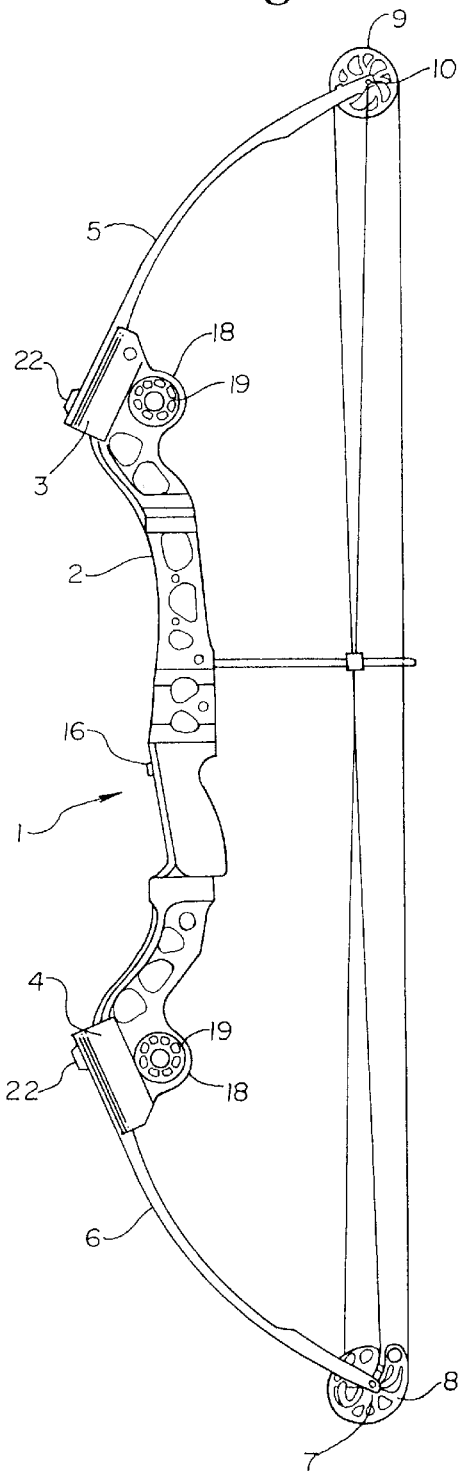
FIG. 1 is a side elevation view of a typical compound bow and illustrates one means of incorporating the incident invention into the bow handle of that bow.

Referring now to the drawings, FIG. 1 depicts a typical compound bow employing the latest technology including the innovative dampers which are the subject of this application. FIG. 1 is a side elevation view of the bow 1 having bow handle 2 to which are attached an upper limb 5 and lower limb 6. The upper and lower limbs are attached to the bow handle 2 using pivotal limb mounting cups 3 and 4 respectively. The bow depicted in FIG. 1 is referred to as a compound bow because located at the extremities of each bow limb are the components comprising a variable leverage system which allows the user to hold the bow at fall draw while expending less effort than required with a traditional bow. A variable leverage device 8 is pivotally mounted on axle 7 at the free end of the lower limb 6 while an idler wheel 9 is pivotally mounted on axle 10 at the free end of the upper limb 5. This particular arrangement has become well known as, the dual feed-out single take-up, single cam system and was first disclosed in U.S. Pat. No. 5,368,006. While FIG. 1 depicts a compound bow of the single cam design the innovation which is the subject of this patent can be applied to compound bows of other designs as well as bows of traditional design. The bow handle 2 in FIG. 1 has been slightly modified at each end in the area behind the limb mounts 18 to make room for the damper assemblies 19 shown in FIG. 3.

Figure 2:
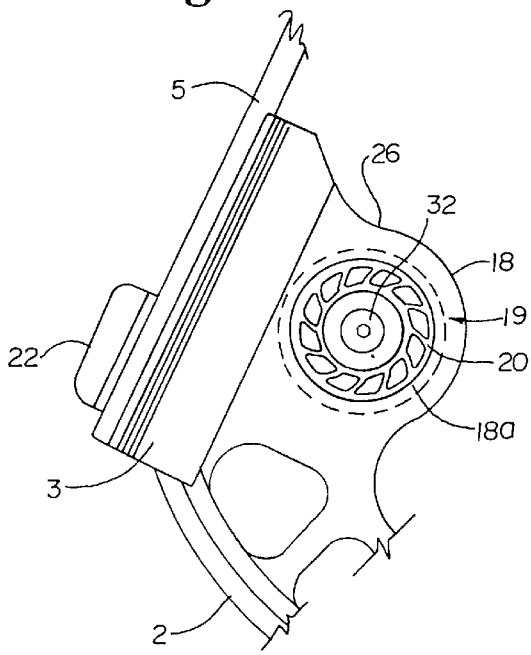
FIG. 2 is close up view of the upper portion of the bow handle as shown in FIG. 1 showing in more detail the location and mounting of the subject damping device.
Figure 3:
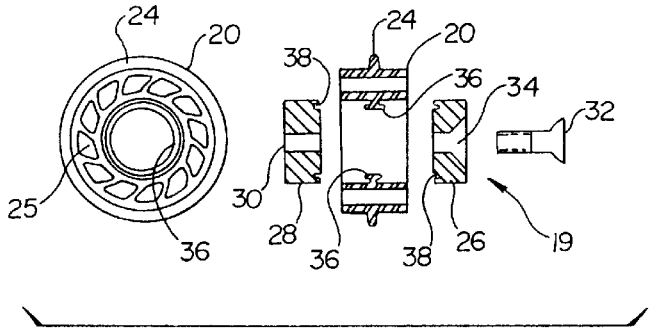
FIG. 3 shows a close up side elevation view of the damper assembly and also an exploded view of the components that comprise that assembly.

FIG. 2 is a close up view of the upper portion of the bow handle showing the damper 19 installed in area 18 of the handle. The resilient or elastomeric portion of the damper 20 has an external annular collar 24 best seen in FIG. 3 that mechanically retains the resilient portion of the damper in a corresponding groove 18*a* (FIG. 2)in the area 18 of the bow handle 2. In this case the resilient portion 20 is inserted into the opening in area 18 of the handle, and the two halves of the weight 26 and 28 are inserted into central opening such that the retaining grooves 38 on each weight half engages the mating portion 36 on the elastomer and the two halves are then secured together with capscrew 32. With the weight in place the elastomer is reinforced such that it is securely held in position mechanically. FIG. 3 shows an exploded view of the elastomer 20 and the components of the weight 26,28 and fastener 32.

Figure 4:
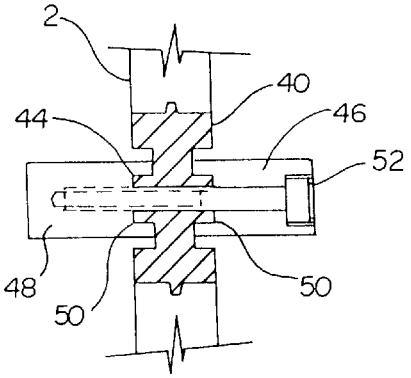
FIG. 4 is a section view through a portion of the bow handle showing a second configuration of the handle damper with a different weighting configuration.

The concept of inserting a resilient or elastomeric damper material into an opening in the bow handle and having that damper material affixed to an inertial mass can be accomplished effectively in a number of different ways. FIG. 4 shows a different shape of the elastomeric damper 40 and the in this case larger weights 46 and 48 are aligned to the damper material matching the annular projection of the damper material 44 with the annular grooves in the weights 50 and attached with capscrew 52.

Figure 5:
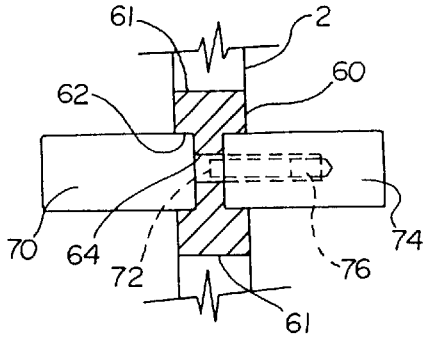
FIG. 5 shows a third section view illustrating another damper configuration having both a different elastomeric mounting means as well as another weight mounting means.

FIG. 5 shows the damper material 60 which is adhesively bonded into the handle 2 at bond line 61 and the weight 70 has a male threaded portion 72 which engages the female threaded portion 76 of the second part of the inertial weight 74. The inertial weights 70 and 74 are located in a mated opening 62 in the damper material 60 and tightened securely against a portion of that material 64.

Figure 6:
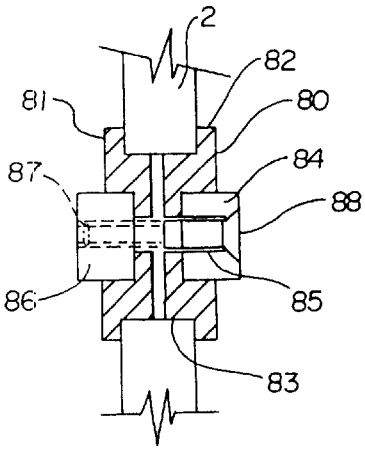
FIG. 6 is a cross section view of a fourth means of constructing and attaching the elastomeric portion of the dampers.

FIG.6 shows another arrangement where the damper is composed two halves 80 and 81 respectively. Each damper half has a portion 83 that fits closely into an opening in the handle for proper alignment additionally each half also has a flanged portion 82 which over laps said opening in the handle such that when the damper halves 80 and 81 are inserted into each side of the handle 2 and the corresponding weights 84, 86 are inserted into pockets in the damper halves and drawn together with fastener 88 the complete damper assembly is held securely into the bow handle 2. Depending on how tightly the weights 84, 86 are drawn into the damper material 80 one has a means to adjust the dampers response without having to make a damper material change.

Figure 7:
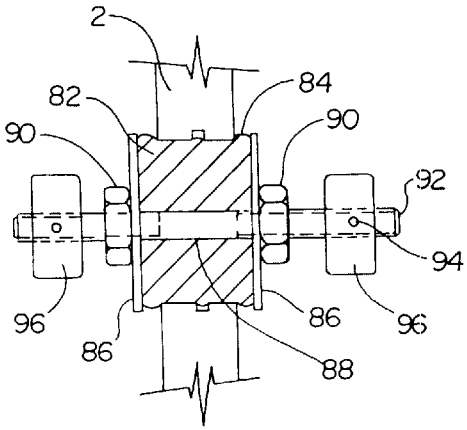
FIG. 7 is a cross section view of a damper arrangement that depicts a fifth means of securing the elastomeric portion of the damper to the bow as well as a variation in attaching the damper weights.

FIG. 7 shows a damper arrangement where the damper material fits into an opening in the bow handle with excess damper material exposed on each side of the handle. The exposed outer surfaces of the damper are engaged by compression plates 86 on both sides of the handle. The compression plates and the damper each have a central opening through which a threaded rod extends. Nuts are threaded on to each end of the threaded rod and engage the compression plates 86 as the nuts 90 are tightened the compression plates 86 apply pressure to the elastomeric damper material 82 causing it to deform 84 around the opening in the bow handle effectively locking the damper in place in the handle 2. Another aspect of this arrangement is that the response of the damping material can also be adjusted by controlling the pressure that the compression plates 86 apply against the damper material 82. An additional feature of this arrangement is that the mass weights 96 can be variably positioned on either side of mounting rod 92 and locked in position using set-screws 94 giving another dimension of adjustability.

Figure 8:
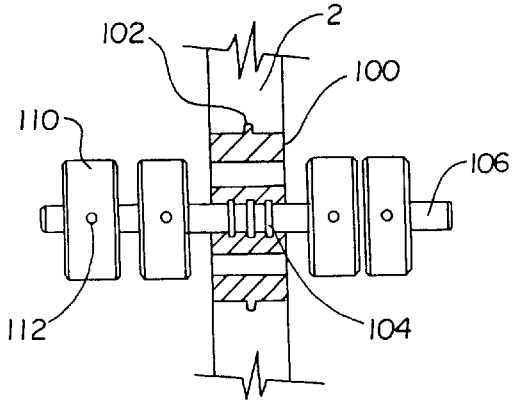
FIG. 8 is another cross section view depicting still another means of attaching the weight assembly to the elastomeric portion of the damper and also illustrates another weighting configuration.

FIG. 8 shows still another arrangement of the damper assembly. In this arrangement the weight supporting rod 106 is attached directly to the damper material 100 either adhesively or as shown here the rod may be designed to be vulcanized, cast, or injection molded 104 into the damper material. This arrangement also shows the versatility that can be achieved in both the amount of weight units 110 and the positioning of the weight to be used. Weights 110 can be located in various positions on rod 106 and secured into position with setscrews 112.

The dampers shown in FIG. 1, FIG. 2, and FIG. 3 are circular in design for several reasons, the circular design is equally responsive in all radial directions in solid or with symmetrically designed openings in the dampers resulting in the ability to absorb energy in a multitude of directions. While the circular design has some obvious manufacturing benefits the dampers could be manufactured in other shapes and be installed in other areas of the bow handle with varying degrees of effectiveness depending on the location chosen and the particular damper design. The effectiveness of dampers as disclosed herein also depends on the damping coefficient of the material chosen the durometer of that material and the final geometry of the damper as well as the configuration and density of the weights attached to the damping material.

Dampers of the configuration shown in FIG. 3 were tested using various materials and material compositions for the elastomeric portion 20. Amongst the materials first tested were Anylin™ and Santoprene™ both in several different durometers (hardness) which gave the indication that the concept could provide the desired effect of making a significant reduction in the shock, vibration and a reduction in the total energy that reaches the users bow hand. The results with the materials used to date also indicates that the dampers performance can be tailored to a given weight range of arrows to be shot and a damper material that performs exceptionally well with light weight arrows may not give the best results when shooting heavier weight arrows.

Figure 9:
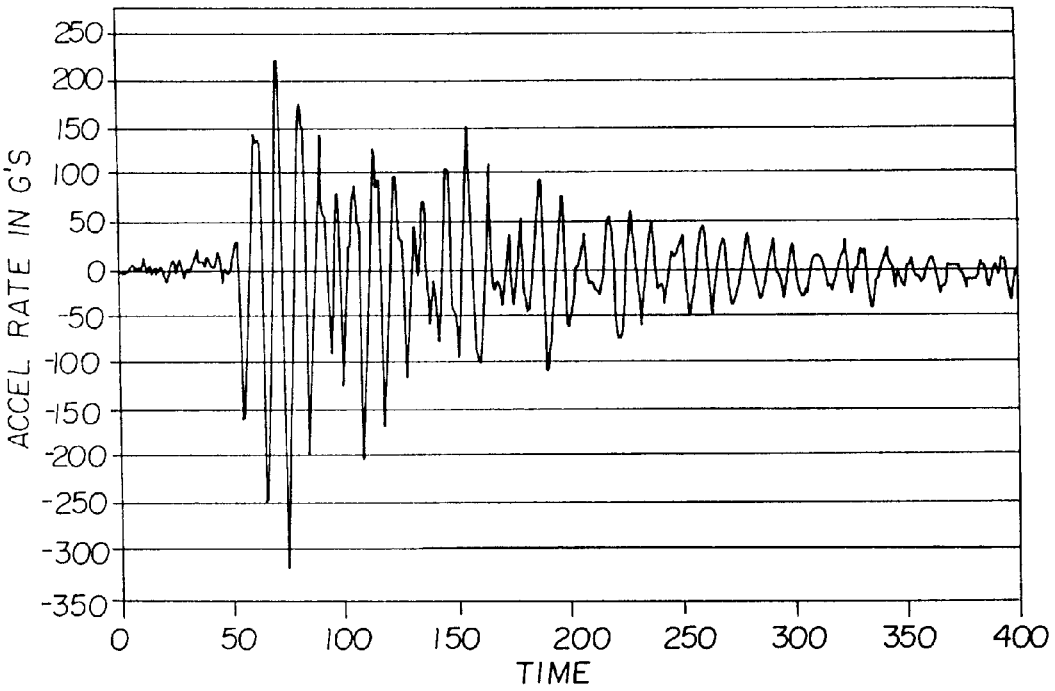
FIG. 9 is a graph showing the acceleration rate of the bow handle in the area of the small of the grip when the bow shoots an arrow weighing 6.2 grains per peak pound of bow draw weight and there are no dampers in the bow handle.
Figure 10:
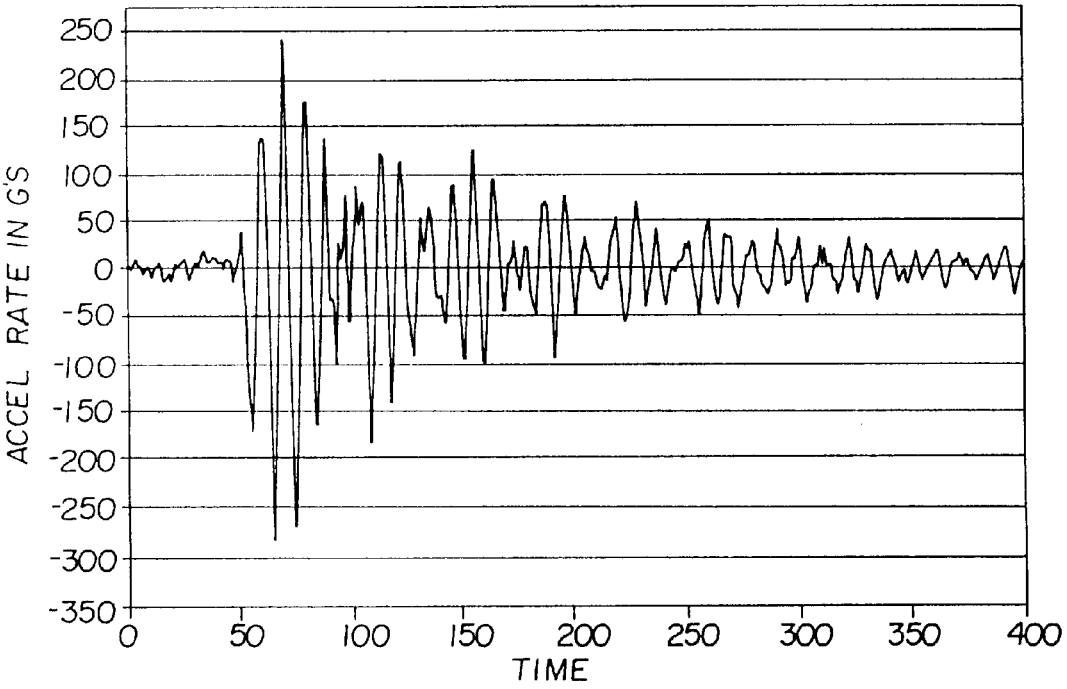
FIG. 10 is a graph showing the acceleration rate of the bow handle under the same conditions as represented in FIG. 9 except that the bow handle had dampers installed.
Figure 11:
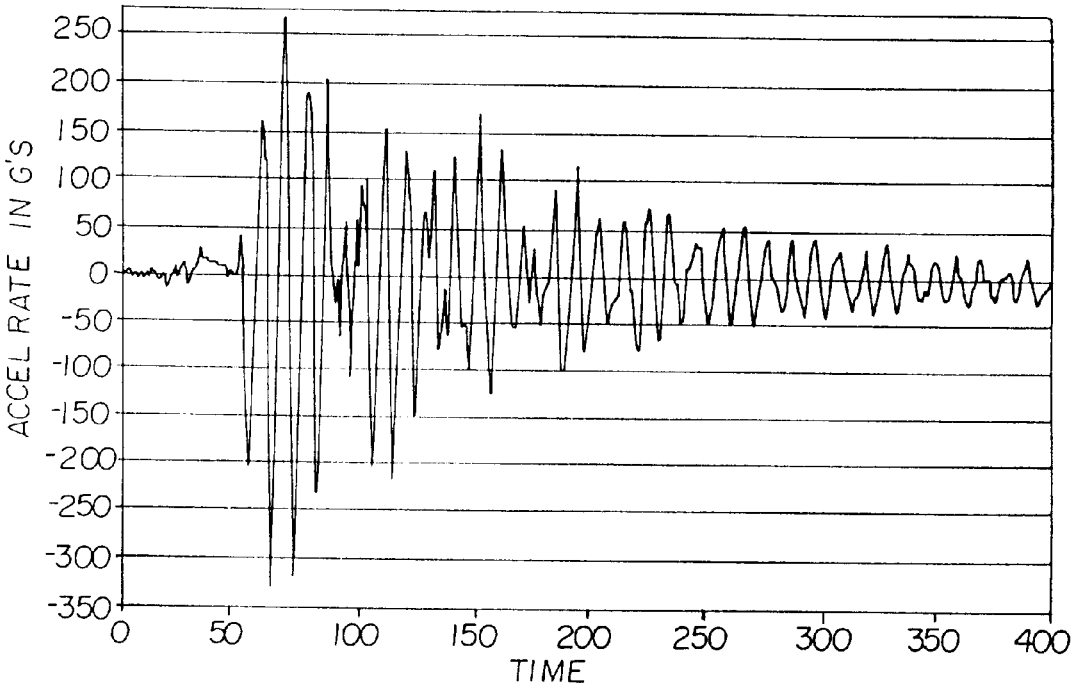
FIG. 11 is a graph showing the acceleration rate of the bow handle in the area of the small of the grip when the bow shoots an arrow weighing 5.5 grains per peak pound of bow draw weight and there are no dampers in the bow handle.
Figure 12:
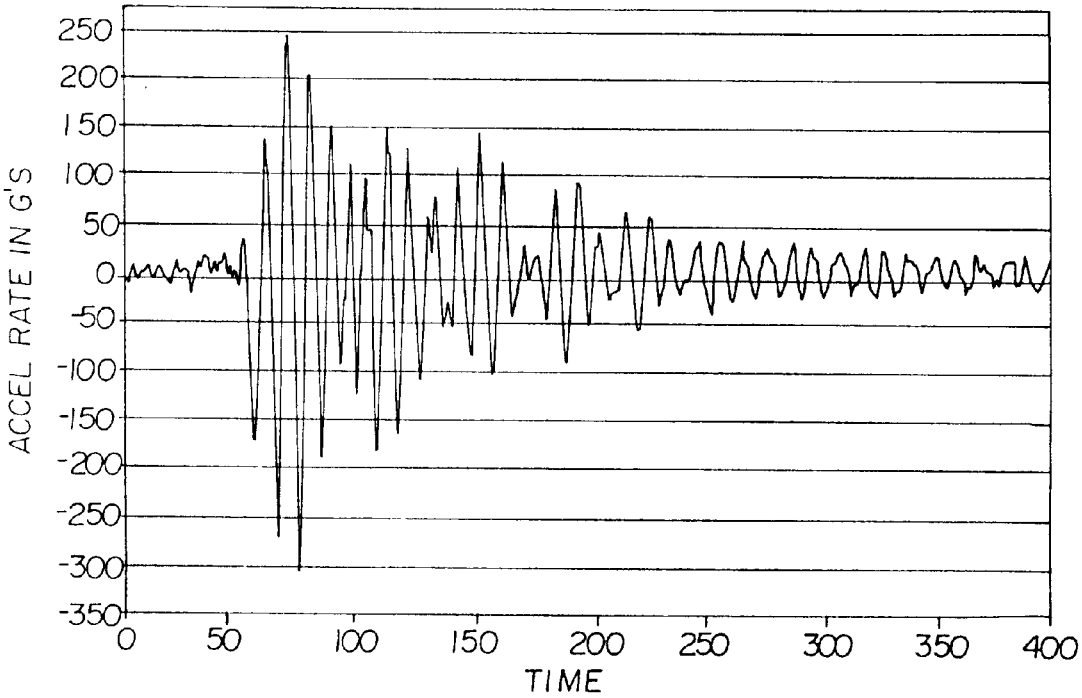
FIG. 12 is a graph showing the acceleration rate of the bow handle when the bow is set-up and shot under the same conditions as represented in FIG. 11 with the exception being that the bow handle was equipped with dampers.

The test bow as shown in FIG. 1 was fitted with an accelerometer 16 located on the back of the handle directly across from the low point in the bows grip. The accelerometer 16 was positioned so as to detect the acceleration rate of the handle in this area in the direction parallel to the arrows launch path. That signal was sent to a Tektronix™ 336 digital storage oscilloscope and then down loaded to a personal computer. Some of the test results are shown here in FIG. 9 thru FIG. 14. FIG. 9 shows the acceleration rate at the grip versus time plot when the bow is shot with a 431 grain arrow and no dampers installed and FIG. 10 shows the same bow set-up with a specific damper installed and shooting the 431 grain arrow. Analysis of these two graphs shows that the average shock force at the bow hand was reduced by 7% while the peak shock forces were reduced by 5%. FIG. 11 shows the results of shooting the same 30" draw, 70# peak weight bow with out dampers and shooting a 385 grain arrow. FIG. 11 should be compared with the chart of FIG. 12 which shows the bows response with dampers installed and shooting the same 385 grain arrow. Analysis of these two graphs indicates that the addition of the dampers resulted in a 13.5 to 15% reduction in the average shock force reaching the archers hand and nearly a 20% reduction in the average Peak shock forces at the archers bow hand. These were rather unexpected results in that most after market shock absorbing stabilizers add considerably more mass to the system and result in providing no more damping effect and in many cases they have less damping effect on the forces and energy reaching the archers bow hand. It can also be shown from the graphs of FIGS. 11 and 12 that when the bow is equipped with dampers the total energy that the bow hand is exposed to is reduced by 10%.

Figure 13:
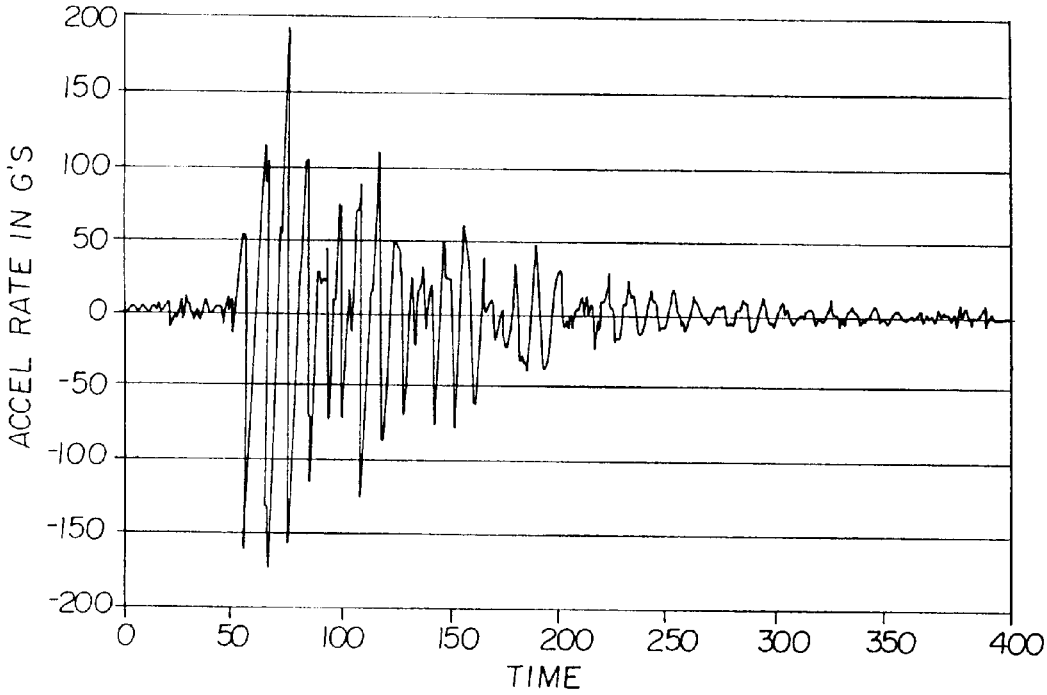
FIG. 13 is a graph showing the acceleration rate of the bow handle in the area of the small of the grip when the handle without the dampers installed is suspended from one end and receives a given impact at the opposite end of the handle.
Figure 14:
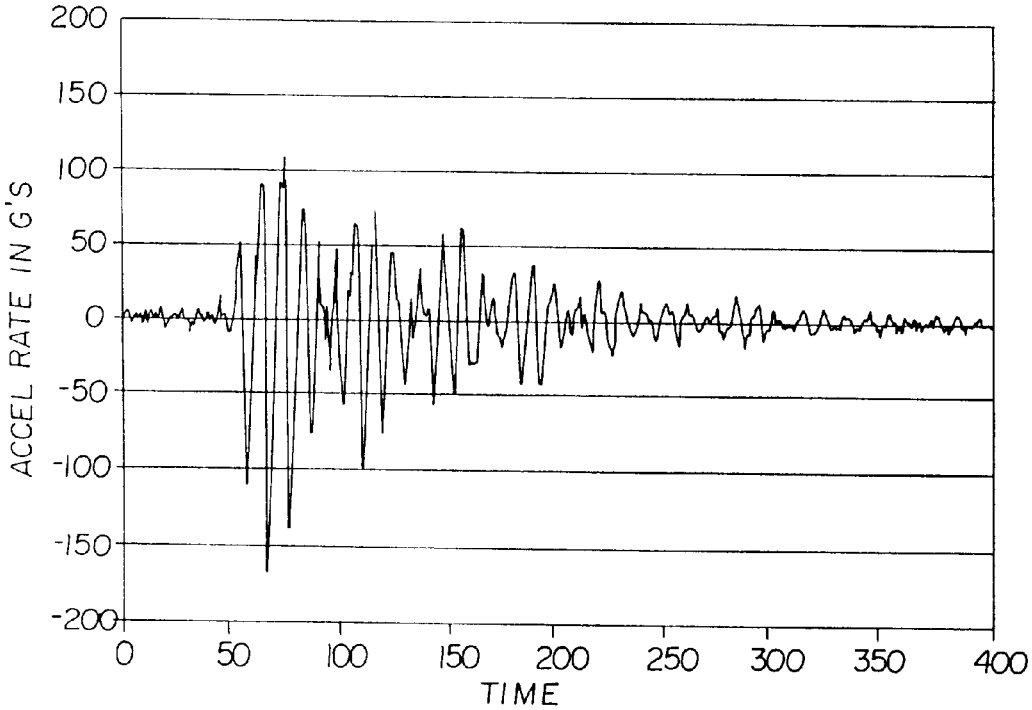
FIG. 14 is a graph showing he acceleration rate of the same set-up and impact conditions as in FIG. 13 except that for this test the handle had the dampers installed.

A second benefit of the dampers is the effect that they have on the secondary ringing vibrations that can occur in the handle when the arrow is shot. This is the same type of effect that occurs when such items as baseball bats, tennis rackets, hammers etc. are subjected to sudden load application or impact. The resulting ringing or stinging vibrations that can occur are less than pleasurable and can effect the users performance. To test the effectiveness of the handle dampers on this type of vibrations the bow handle 2 was disassembled from the bow and freely suspended from one end with the accelerometer 16 attached as described earlier. The handle was hen impacted identically with and without the dampers installed. FIG. 13 is the graph of the bow handles response when the dampers were removed and FIG. 14 is the response of the handle with the dampers in place. Comparing the graphs, one finds that the handle with dampers has a reduction of 20% in the magnitude of the peak acceleration forces over the first 75 milliseconds after impact and the time required for the major vibrations to dampen out was reduced by a factor of 3.5 to 5.5 depending on the specific damper configuration and damper material used.

Figure 15:
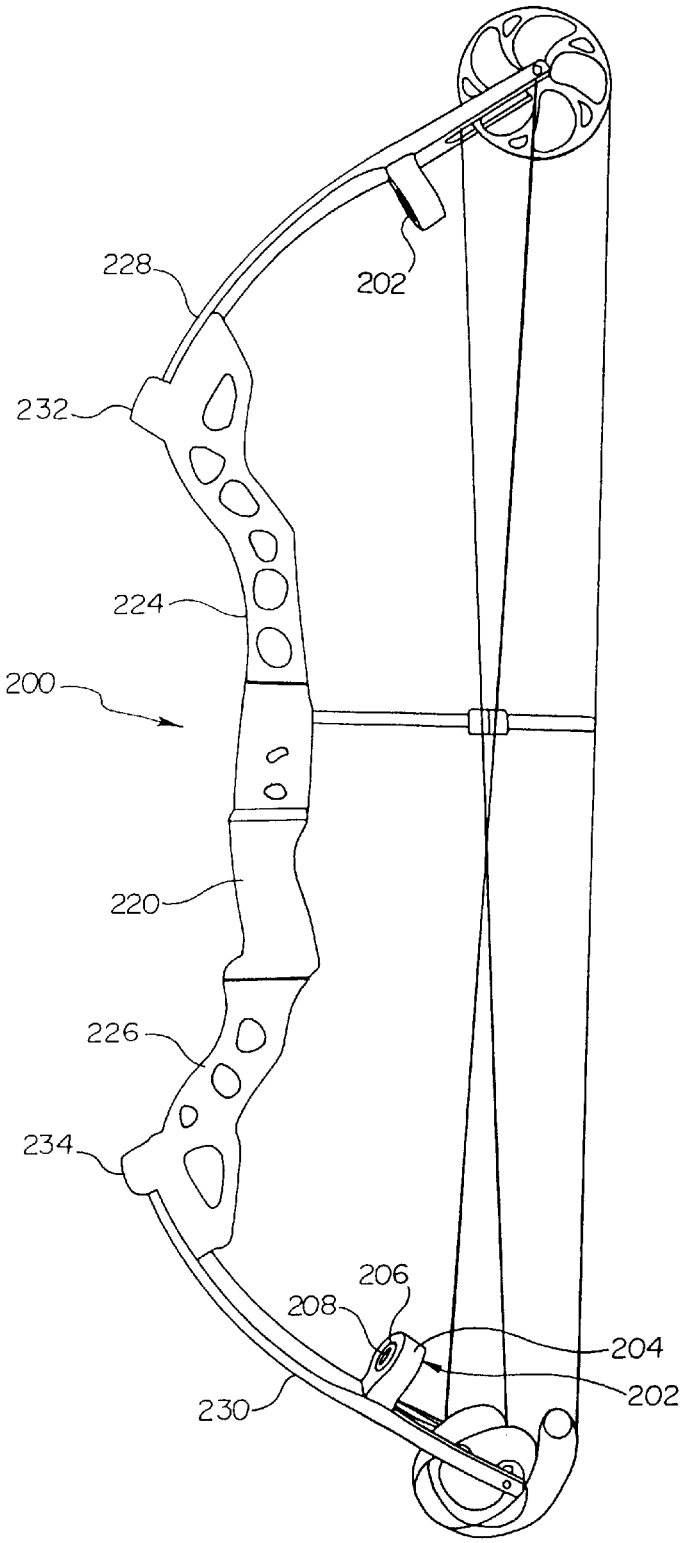
FIG. 15 is a side elevation view of a typical compound bow and illustrates another means of incorporating the incident invention into the limbs of a bow.

FIG. 15 depicts another typical compound bow 200 employing the latest technology including an alternative embodiment of dampers 202. In the present embodiment the dampers 202 may be an inherent part of the bow's construction such as may be seen in FIG. 1, or the dampers 202 may be a device which may be separated from the bow 200 as may be seen in FIG. 15. The construction of the present embodiment of the damper 202 includes a housing 204 which contains a resilient or elastomeric portion 206 and a weighted portion 208. The elastomeric portion 206 is preferably elastic, and may be constructed in whole or in part from a variety of materials including: Anylin™, Santoprene™, rubber. Other materials may be used which provide the dampener 202 with the desired vibrational dampening characteristics as previously described.

The outside of the housing 204 may also include a means for attachment to the bow 200. The attachment means may be embodied by many different devices or attachment methods. In the present embodiment the attachment means one or more post assemblies 210 which may be secured to virtually any portion of the bow, including any portion of the handle 220; risers 224, 226; limbs 228, 230; and limb cups 232 and 234. In alternative embodiments of the invention the damper 202 may include attachment means more suitable for attaching the damper 202 to any of the wide variety of bow accessories which may be a part of, or attached to, the bow 200 as shown in FIGS. 15*a* and 15*b*.

Figure 15A:
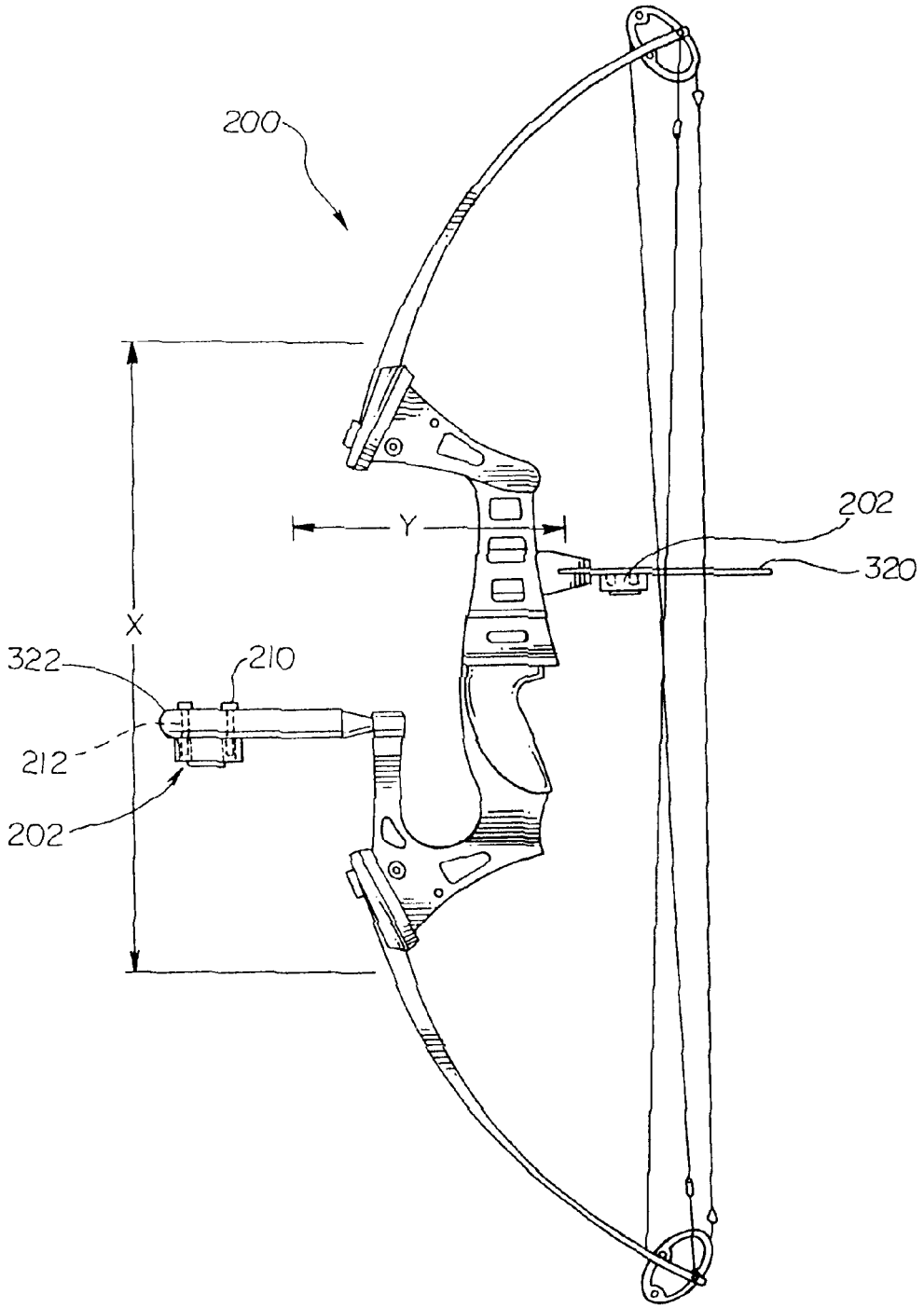
FIG. 15*a* is a side elevation view of a typical compound bow equipped with examples of common bow accessories and illustrates means of incorporating the present invention on to bow accessories.

FIG. 15*a* shows a typical compound bow 200 which includes a dampers 202 mounted to the cable guard 320 as well as a stabilizer 322. Cable guards are a typical component of most modern compound bows and are well known in the art. Stabilizers are also known and may be embodied in a variety of shapes, sizes and configurations. For example U.S. Pat. No. 5,803,070 to Martin et al.; U.S. Pat. No. 5,615,664 to McDonald Jr.; U.S. Pat. No. 5,611,325 to Kudlacek; and U.S. Pat. No. 5,595,169 to Brown Jr., the entire contents of each which is hereby incorporated by reference, each describe various bow stabilizers and cable guards which may be associated or equipped with a damper 202 as presently described.

Figure 15B:
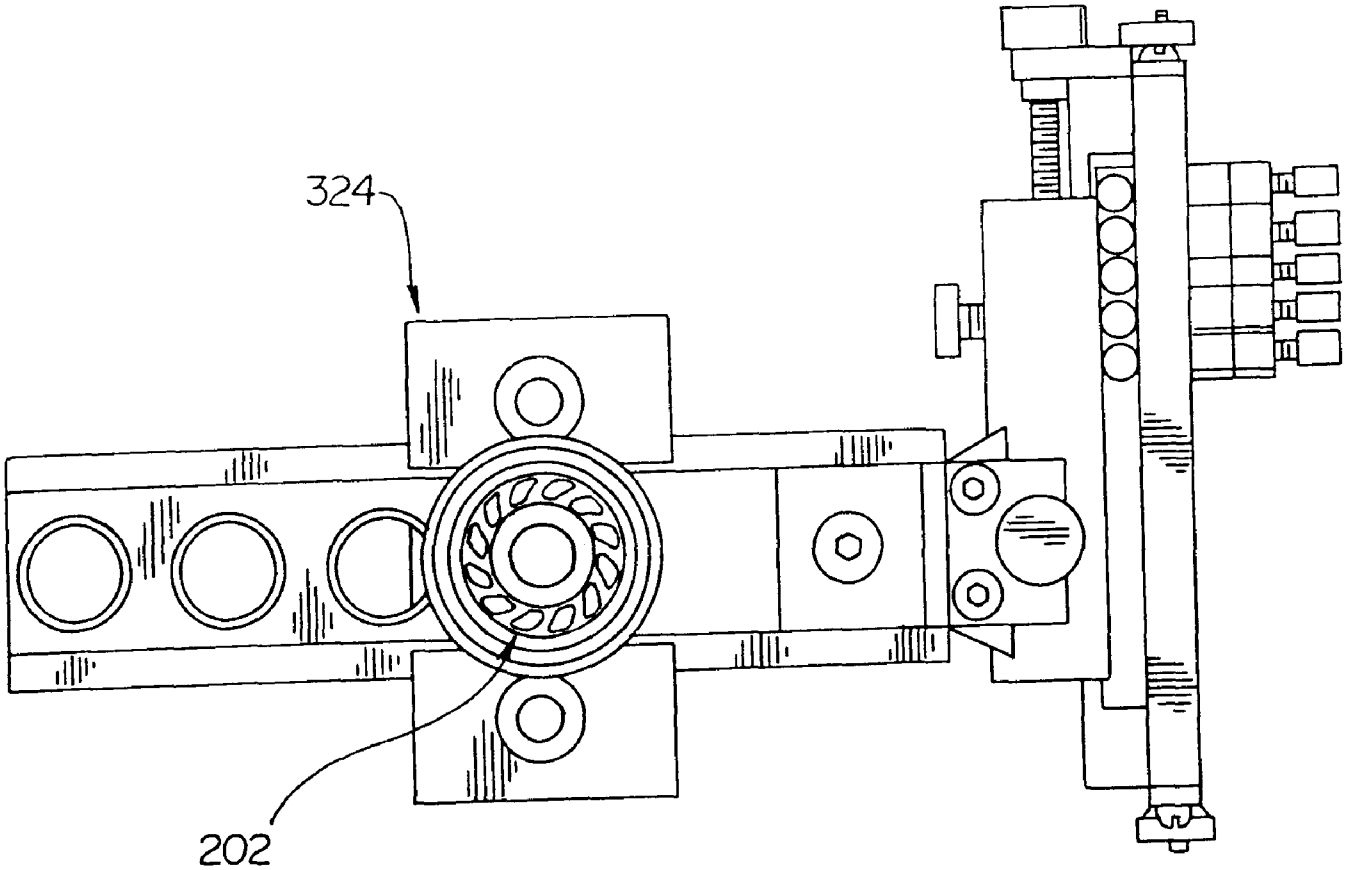
FIG. 15*b* is a side elevation view of a typical bow sight equipped with an embodiment of the present invention.

FIG. 15*b* shows an example of a typical bow sight 324 which may be mounted to a compound bow such as shown and described herein. The bow sight shown in FIG. 15*a* has been fitted with a damper 202. Any type of bow sight could be fitted with the present damper 202. Some examples of bow sights which may be fitted with a damper 202 are described in U.S. Pat. No. 5,517,979 to Closson; U.S. Pat. No. 4,788,961 to Toth; U.S. Pat. No. 4,535,747 to Kudlacek; and U.S. Pat. No. 4,142,298 to Killian, the entire contents of each which is hereby incorporated by reference.

As may be seen in FIGS. 15*a* and 15*b,* the damper 202 may be attached to any accessory including the cable guard 320, stabilizer 322, bow sight 324 or other device by any suitable attachment means as may be understood by one or ordinary skill in the art. For example, post assemblies 210 and securement holes 212 as described in detail below, may be sufficient to attach the damper 202 to the respective accessory 320, 322, 324. Where the respective accessory lacks the proper size or shape to receive posts 210 other attachment means may be used which could include welding the damper 202 to the respective accessory 320, 322, 324 or other accessory, applying an adhesive between the accessory and the damper 202, etc.

The damper 202 can easily be configured such that the housing 204 and the elastomeric portion are combined into a single unit which is molded of a suitable damping material. In this manner the damper and housing become a single unit which can house the weighted portion 208. As seen in FIG. 15, the combination damper housing thus configured can have at least one surface suitable to be adhesively bonded to the bow.

Figure 16:
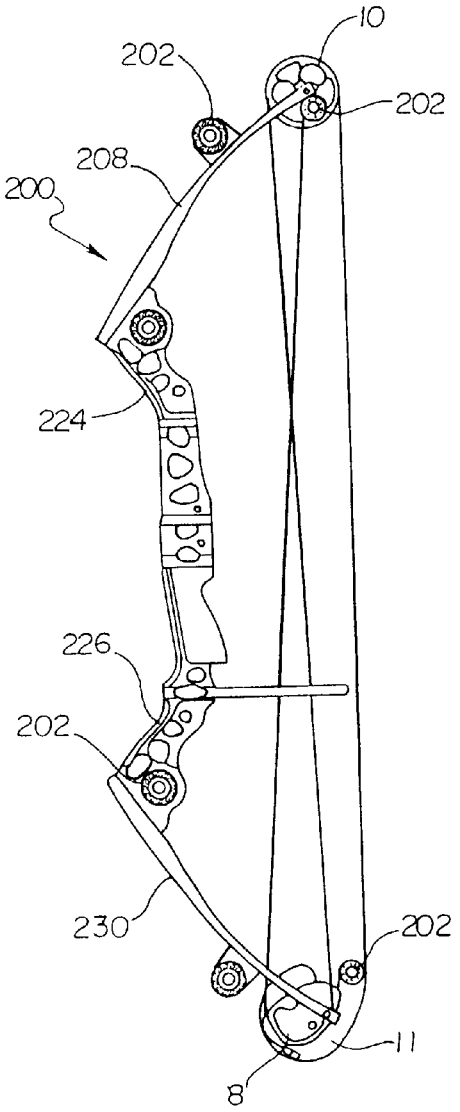
FIG. 16 is a side elevation view of a typical compound bow and illustrates two embodiments of the present invention where the invention is incorporated as original hardware and a retro-fitted assembly on the bow.
Figure 17:
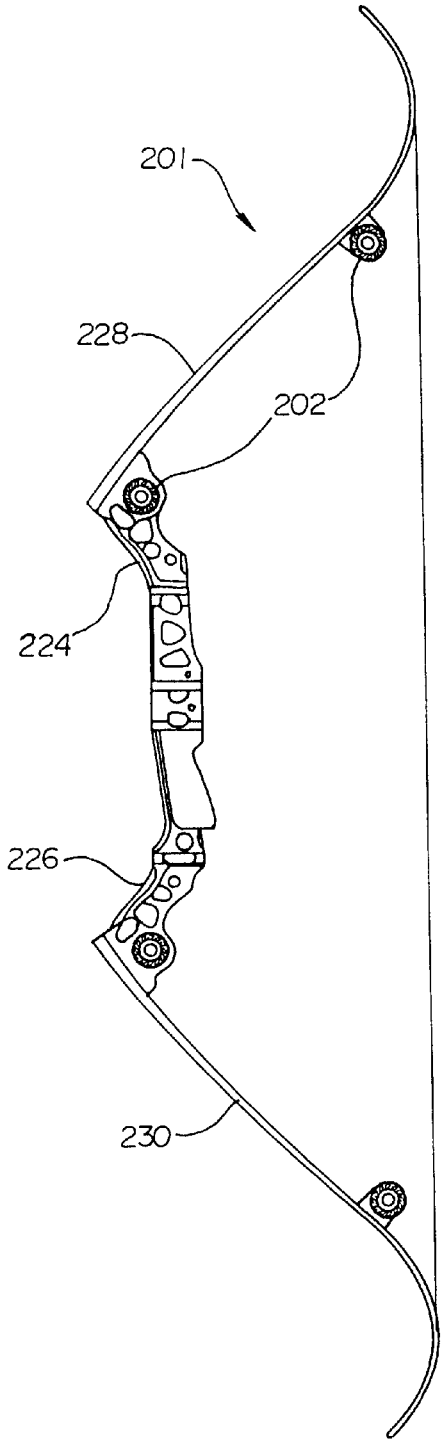
FIG. 17 is a side elevation view of a typical recurve bow and illustrates two embodiments of the present invention where the invention is incorporated as original hardware and a retro-fitted assembly on the bow.
Figure 18:
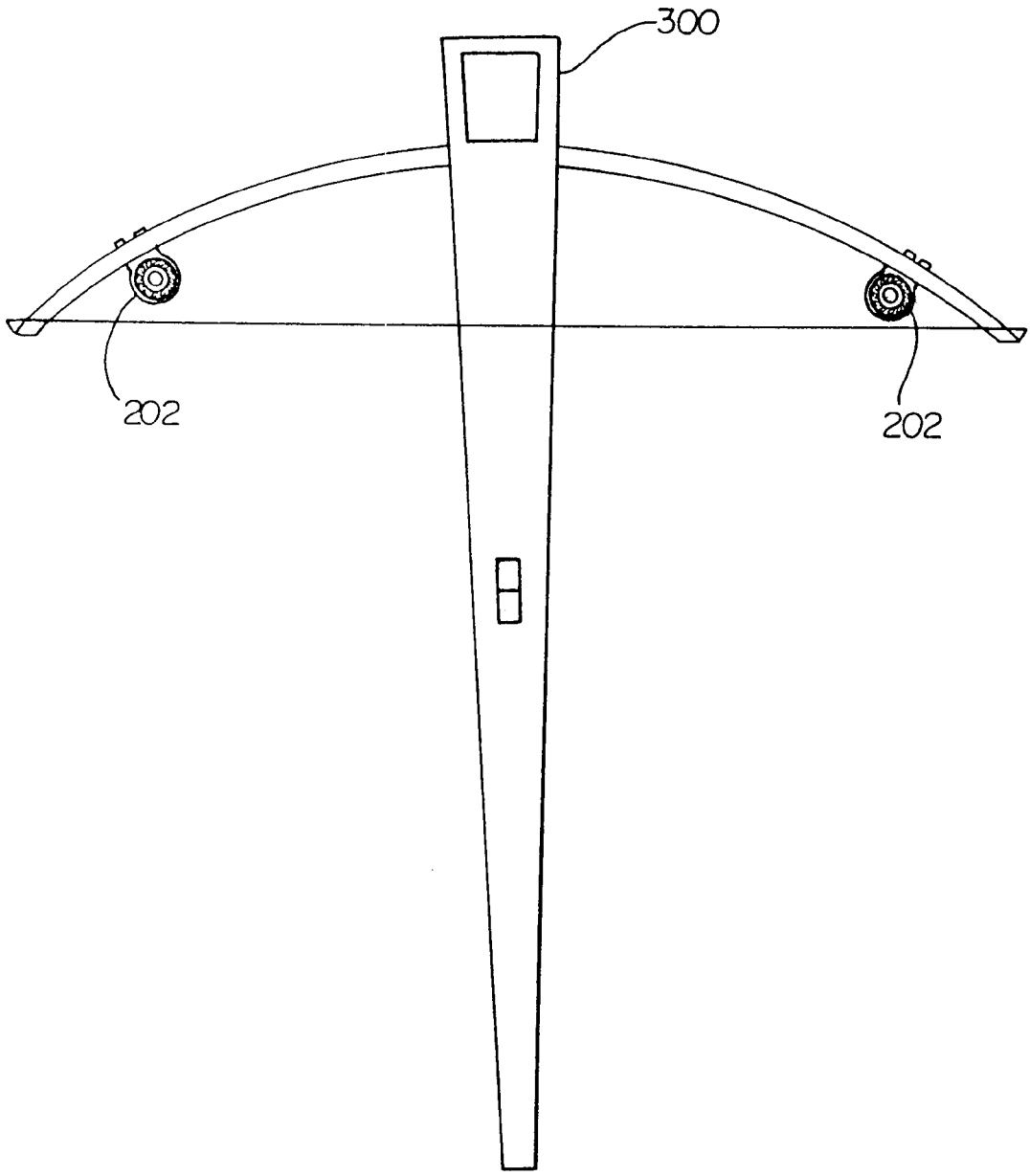
FIG. 18 is a top down view of a typical cross-bow fitted with an embodiment of the present invention.

FIG. 16 shows another compound bow 200 which has dampers 202 located on the upper limb 228, lower limb 230, upper riser 224 and lower riser 226. Dampers 202 may also be located in each of the rotating elements 10 and 11. Similarly FIG. 17 shows a more traditional recurve bow 201 which includes limbs 228 and 230 as well as upper and lower risers 224 and 226 which all have a damper 202 associated therewith. FIG. 18 shows a cross-bow 300 equipped with a pair of dampers 202.

In one embodiment of the damper 202 such as may be seen in FIGS. 15–18 and further below in FIGS. 20–21, the individual dampers 202 may be retro-fitted to the bow 200. Such retro-fit dampers 202 may include attachment means embodied such as two post assemblies 210 which are passed through securement holes 212. Securement holes 212 may be preexisting features located on any portion of the bow. The post assemblies 210 may incorporate features such as a thread pattern 211 so as to be threadingly received by fasteners 214 and thereby be secured to the bow 200. Alternative devices, methods, and arrangements may be employed to secure one or more dampers 202 to a bow, such as the application of an adhesive between the surfaces' of the bow and damper, the use of one or more clamps, slides, locking mechanisms, etc.

Figure 19:
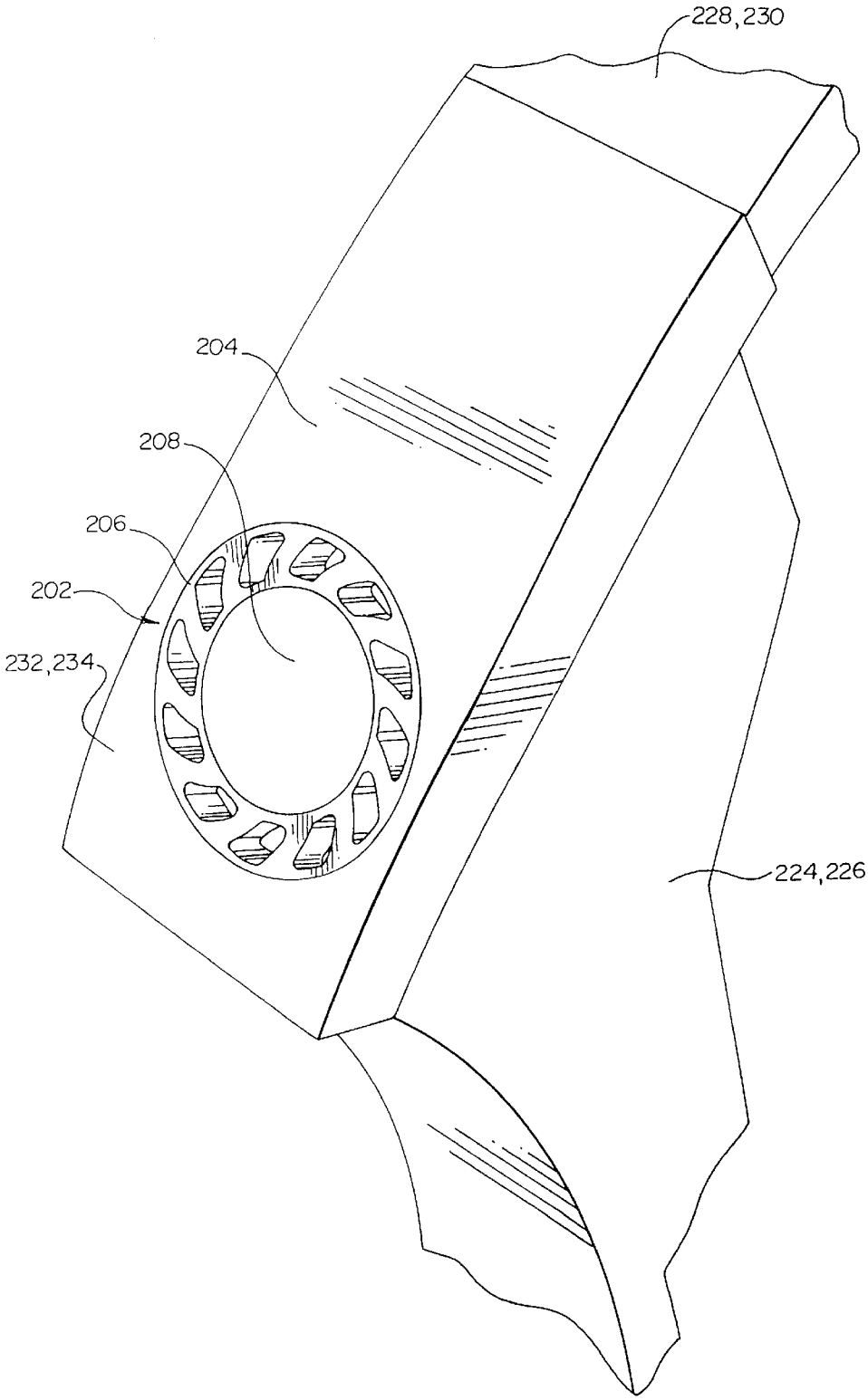
FIG. 19 is a close-up view of a riser and limb of a typical compound bow including an embodiment of the present invention positioned within the limb cup.

As may be seen in FIG. 19 an additional embodiment of the invention provides for the damper 202 to be contained within one or both of the limb cups 232, 234.

Figure 20:
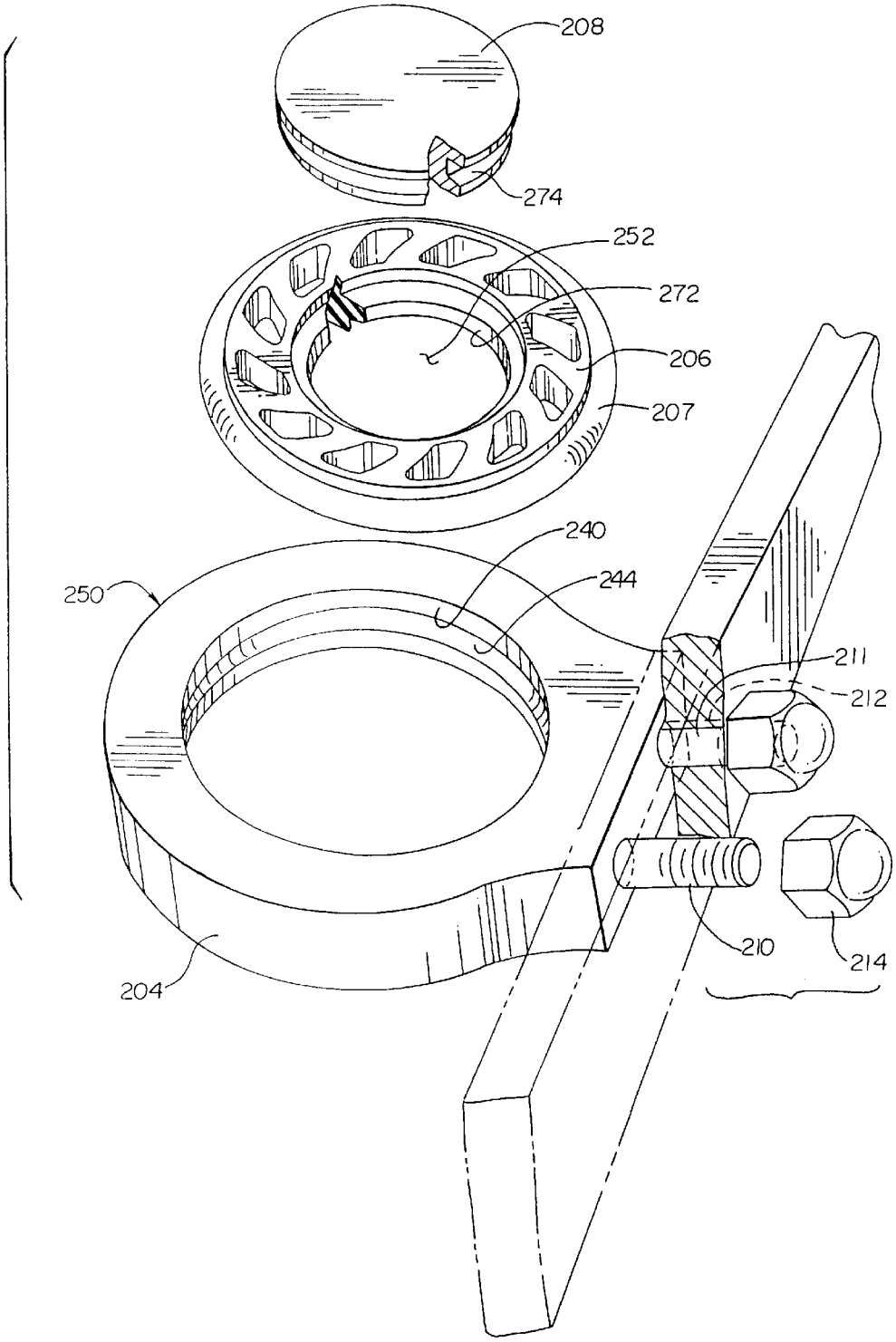
FIG. 20 shows a close up side elevation view of an embodiment of the damper assembly and an exploded view of the components that comprise the damper assembly.

In FIG. 20 an embodiment of the damper 202 is shown in detail. As may be seen from FIG. 20 the housing 204 includes an inner surface 240 and an outer surface 250. The inner surface 240 of the housing 204 includes a receiving surface 242 which may be embodied in a variety of ways such as by including one or more indentations or the present uniform radial groove 244 which receives and engages an annular collar 207 of the elastomeric portion 206.

Figure 21:
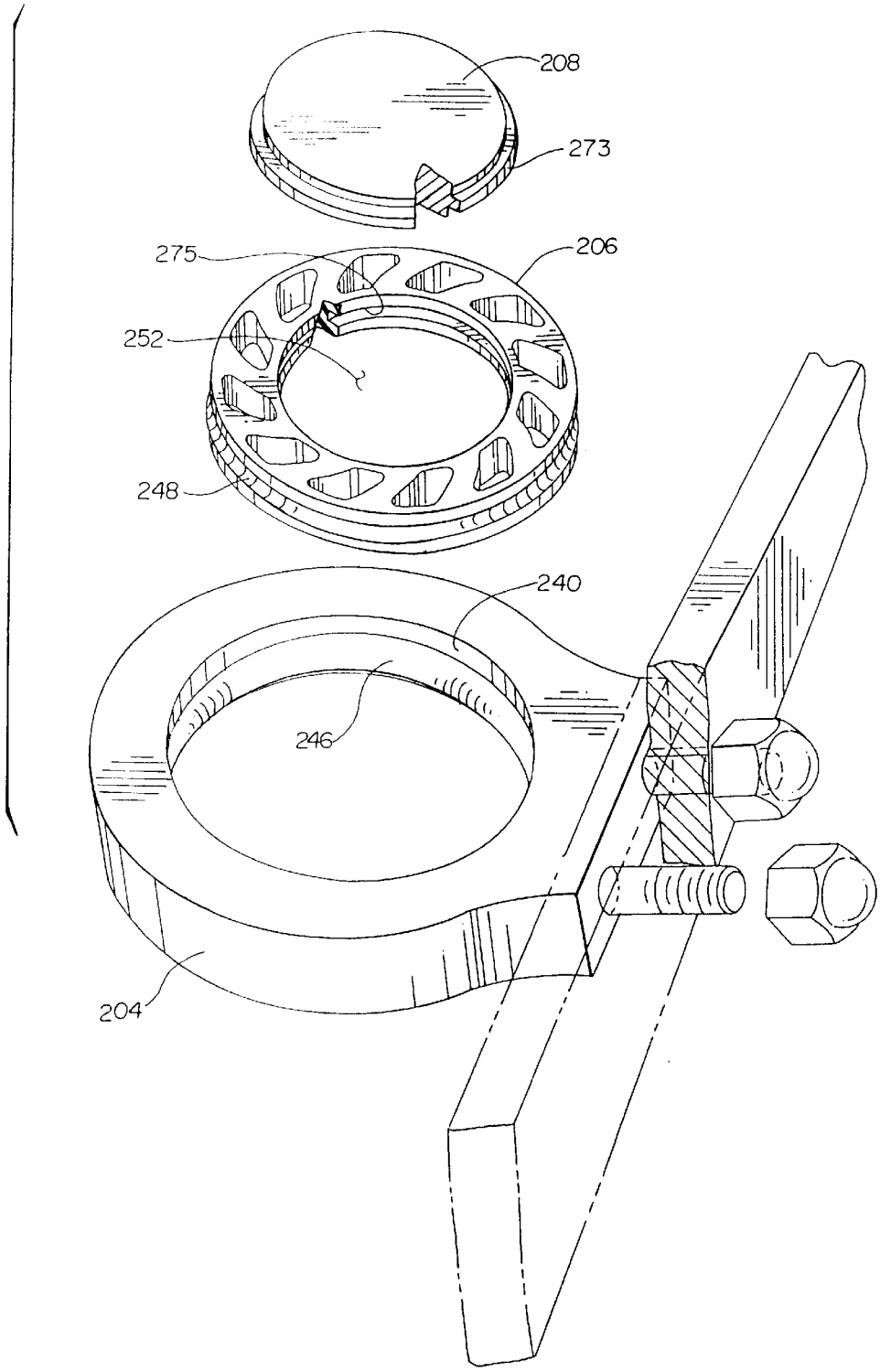
FIG. 21 shows a close up side elevation view of another embodiment of the damper assembly and an exploded view of the components that comprise the damper assembly.

An alternative embodiment of the damper 202 is shown in FIG. 21 wherein the inner surface 240 of the housing 204 includes a protruding lip 246. In the alternative embodiment shown in FIG. 21 the elastomeric portion 206 may be alternatively configured to include a mounting groove 248. The mounting groove 248 receives and frictionally engages the lip 246, thereby providing for a means of associating the elastomeric portion 206 with the housing 204.

In the various embodiments shown in FIGS. 15–21 the dampers 202 include weighted portions 208 which are retained within the central region 252 of the elastomeric portion 206. Different weighted portions 208 may be used with a given damper 202. Weighted portions having different masses may provide the damper 202 with varying performance characteristics which an individual user may find more or less desirable. As a result, different weighted portions may have varying masses but should have substantially similar diameters in order to ensure that the weighted portions may be utilized with a given elastomeric portion.

The dampers 202 and particularly the weighted portions 208 of the damper 202 may be embodied in many different forms. For example, the weighted portion 208 shown in FIGS. 15–21 may be a distinct mass of material such as metal, a metal alloy, plastic, rubber, etc, which may be different from or the same material as the elastomeric portion.

In the various embodiments shown in FIGS. 15–20 the central region 252 of the elastomeric portion 206 includes a mating portion 272. The mating portion 272 is constructed and arranged to be received and retained by a mating groove 274 located on the outside surface 270 of the weighted portion 208. In the embodiment shown in FIG. 21 the central region 252 includes an elastomeric mating groove 275 which receives and retains a mating extension 273 of the weighted portion 208.

It should be noted that the various groove and collar arrangements shown in FIGS. 20 and 21 are merely examples of configurations which may be used to join the housing 204, the elastomeric portion 206 and the weighted portion 208. The configurations shown and described herein are preferred, as they allow a user to remove and replace the various components as desired. Alternative arrangements may include the application of permanent or temporary adhesives as well as other interfacing arrangements. The present invention is directed at these configurations and all other which may be known to one of ordinary skill in the art.

Figure 22:
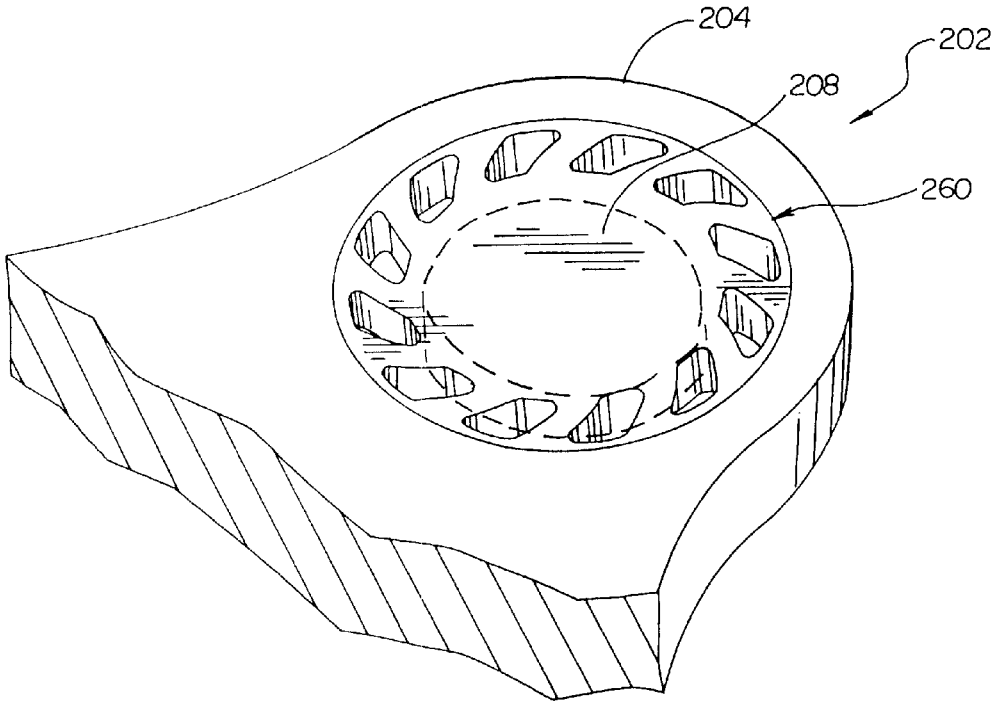
FIG. 22 shows a close up side elevation view of another embodiment of the damper assembly and a view of the components that comprise the damper assembly.

In an alternative embodiment shown in FIG. 22, the elastomeric layer and the weighted portion are composed of the same material and have in essence joined together to form a continuous damper portion 260. Where the damper 202 includes a continuous damper portion 260, the damper portion is preferably constructed from a fairly flexible material such as rubber or plastic. The damper portion 260 may be associated with housing 208 in the same manner as the elastomeric portion 206 such as the arrangements shown in FIGS. 20 and 21 as well as any other manner as may be understood by those of ordinary skill in the art.

Figure 23:
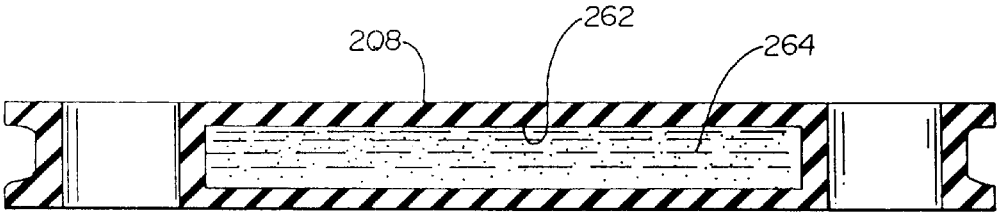
FIG. 23 shows a side view of a weighted portion of an alternative embodiment of the present invention.

In yet another alternative embodiment shown in FIG. 23, the weighted portion 208 may include a hollow 262 which defines a predetermined volume of space which is at least partially occupied by a counteracting weight material 264. In the various embodiments envisioned, the counteracting weight material may be a fluid such as water, oil, mercury, etc.; or another type of flowable material such as sand or particulate material such as a plurality of small beads of tungsten, aluminum, lead, steel, rubber, plastic or other material including metal alloys. The vibrational energy present in the bow and bow components, after an arrow is released, will be at least partially dampened and absorbed by the movement of the counteracting weight material 264 within the hollow 262.

Figure 24:
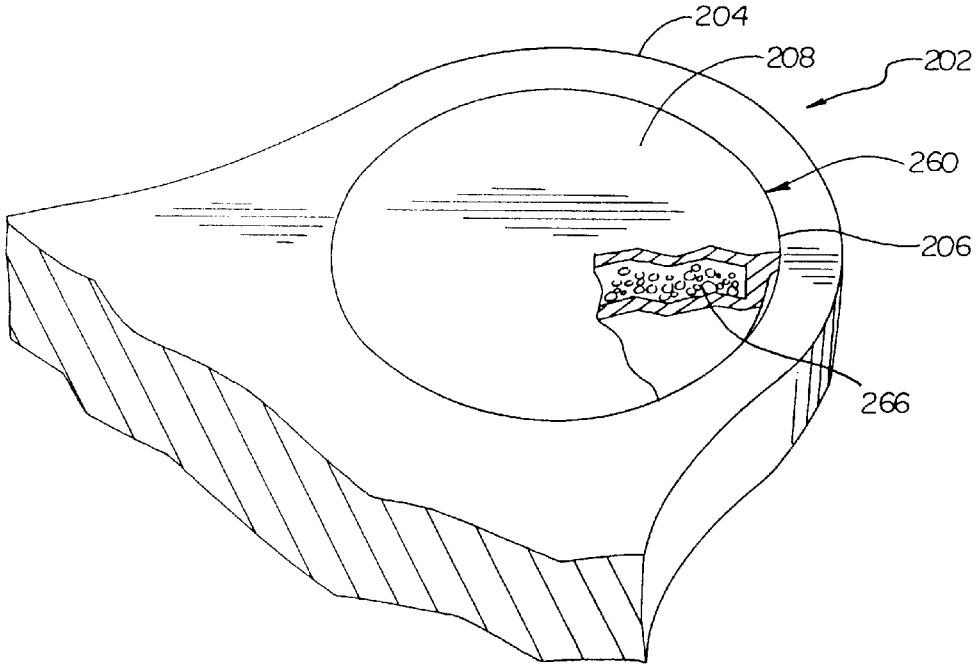
FIG. 24 shows a top down view of another embodiment of the damper assembly.

Alternatively, the hollow 262 and weighted portion 208 may be embodied in the uniform damper portion 260 such as shown in FIG. 24, wherein the elastomeric portion 206 is incorporated into the damper portion 260 and the damper portion 260 includes a hollow 262. Where the damper portion 260 includes a hollow 262 as shown in FIG. 24, the uniform damper portion 260 may be constructed from a relatively rigid material such as metal. In any of the embodiments shown in FIGS. 23 and 24, the hollow 262 may contain any variety of counteracting weight material 264 such as a fluid, a plurality of particulate matter, or a combination thereof. In alternative embodiments the hollow 262 may contain only particulate 266 matter such as sand, plurality of the aforementioned beads or other comparatively loose material exclusive of a fluid medium.

Figure 25:
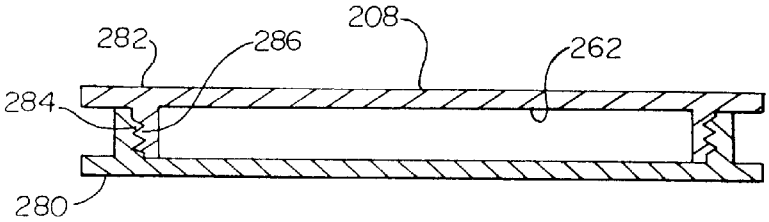
FIG. 25 shows a side view of a weighted portion of an alternative embodiment of the present invention.
Figure 26:
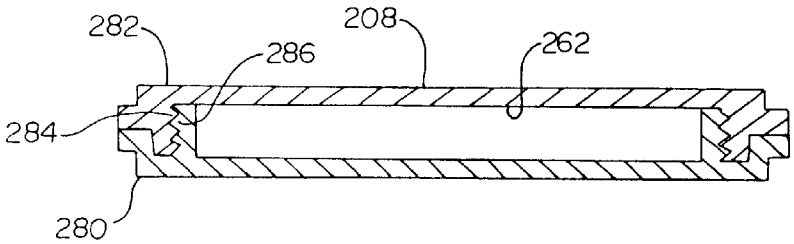
FIG. 26 shows a side view of a weighted portion of an alternative embodiment of the present invention.

In order to provide for the ability to customize the damper 202 to an individual user's preferences it may be desirable to provide the damper 202 with the ability to vary the mass of the weighted portion 208 or damper portion 260. As may be seen in FIGS. 25 and 26 respectively, the weighted portion 208 may be constructed to include a first half 280 and a second half 282 so that the hollow 262 may be opened and its contents removed and/or replaced. The first half 280 of the weighted portion 208 or damper portion 260 may include any means known for removably connecting to objects together. For example the halves 280 and 282 may be press fit by frictional engagement of their respective surfaces to each other. Preferably, in the embodiment shown, the halves 280 and 282 may include a first threaded portion 284 which threadingly engages an opposingly threaded second threaded portion 286 located about the second half 282. Such an arrangement will provide the weighted portion 208 or damper portion 260 respectively, with the capacity to be readily manipulated by a user who may then access and vary the contents of the hollow 262 as may be desired.

Figure 27:
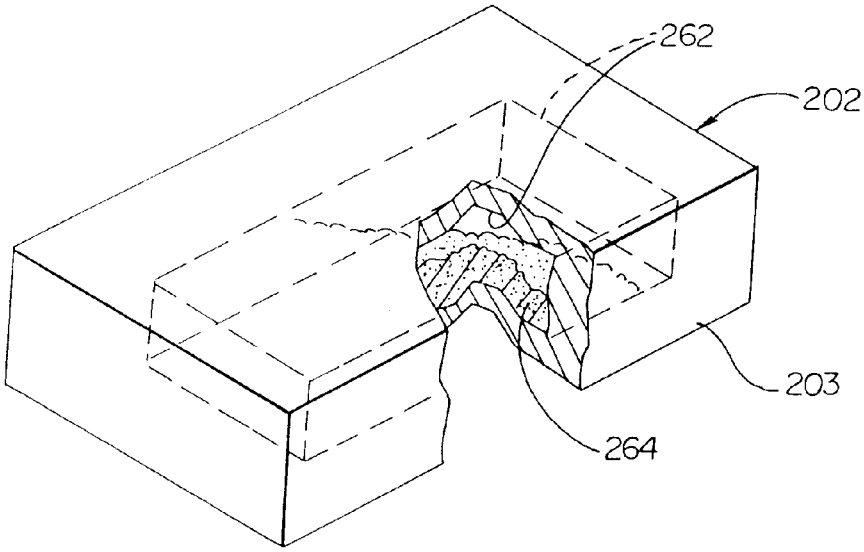
FIG. 27 shows a perspective view of yet another alternative embodiment of the invention.

As may be seen in yet another embodiment of the present invention shown in FIG. 27, the damper 202 may be a single a hollow object, wherein the hollow portion 262 is partially filled with a counteracting weight material 264 as previously described. In the embodiment shown, the damper 202 comprises a housing or shell 203 which as previously indicated contains an inner hollow portion 262. The shell 203 may be constructed from virtually any material and is preferably constructed from aluminum or other metal, plastic, an elastomeric material such as rubber, or any combination thereof.

Figure 28:
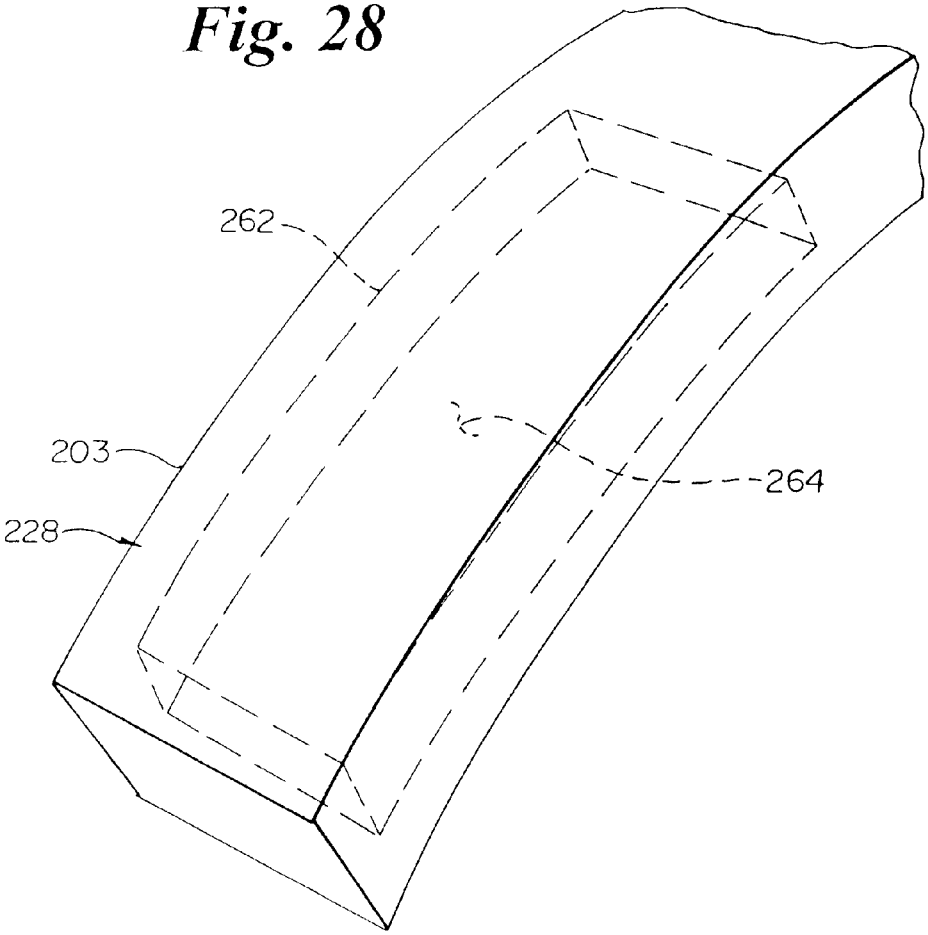
FIG. 28 shows a perspective view of yet another alternative embodiment of the invention.

The shell 203 may be attached or connected to any portion of a bow through the use of any of the attachment means previously described. The shell 203 may be embodied in a wide variety of shapes and sizes. For example, in an alternative embodiment shown in FIG. 28 the shell 203 is actually a portion of the upper bow limb 228.

The invention may be embodied in many forms without departing from the spirit or the essential characteristics of the invention. For example, a number of variations on the configuration of the elastomeric portion of the damper and the means of attaching that portion to the various parts of the bow, along with several different weighting concepts and means of attachment of those weights to the elastomeric portion have been disclosed but they do not by any means cover the full scope of the invention. The present embodiments are therefore to be considered in all respects as illustrative and not restrictive. The scope of the invention is indicated by the appended claims rather than by the foregoing description. All changes that come within the meaning and range of equivalency of the claims are intended to be embraced therein.

In addition to being directed to the embodiments described above and claimed below, the present invention is further directed to embodiments having different combinations of the features described above and claimed below. As such, the invention is also directed to other embodiments having any other possible combination of the dependent features claimed below.

The above examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. A dampening device for use with an archery bow, the dampening device absorbing vibrational energy which results from shooting an arrow from the bow, the dampening device comprising:

a housing, a resilient member, and a weighted portion;

the housing comprising a portion of a bow having an inside surface suitable for engaging and retaining the resilient member therein, the resilient member having an inside surface suitable for engaging and retaining the weighted portion therein.

2. The dampening device of claim 1 wherein the resilient member is elastic.

3. The dampening device of claim 1 wherein the resilient member is constructed at least partially from plastic.

4. The dampening device of claim 1 wherein the resilient member is constructed at least partially from rubber.

5. The dampening device of claim 1 wherein the portion of the bow is selected from at least one member of the group consisting of a handle, an upper riser, a lower riser, an upper limb cup, a lower limb cup, an upper limb, a lower limb and any combination thereof.

6. The dampening device of claim 1 wherein the housing further comprises an outer surface, the outer surface having a means for attaching the housing to a portion of the bow.

7. The dampening device of claim 6 wherein the attachment means comprises at least one securement post which extends from the outer surface, said at least one securement post constructed and arranged to be received and retained by the portion of the bow.

8. The dampening device of claim 7, the portion of the bow comprising at least one member of the group consisting of a handle, an upper riser, a lower riser, an upper limb cup, a lower limb cup, an upper limb, a lower limb or any combination thereof.

9. The dampening device of claim 1 wherein the resilient portion further comprises a mating portion.

10. The dampening device of claim 9 wherein the weighted portion further comprises a mating groove, the mating groove constructed and arranged to receive and removably retain the mating portion.

11. The dampening device of claim 1 wherein the resilient portion further comprises an elastomeric mating groove.

12. The dampening device of claim 11 wherein the weighted portion further comprises a mating extension, the mating extension constructed and arranged to be received and removably retained by the elastomeric mating groove.

13. A dampening device for use with an archery bow, the dampening device absorbing vibrational energy which results from shooting an arrow from the bow, the dampening device comprising:

a housing, a resilient member, and a weighted portion;

the housing comprising a portion of a bow accessory, the bow accessory selected from the group consisting of a sight or a cable guard, the housing having an inside surface suitable for engaging and retaining the resilient member therein, the resilient member having an inside surface suitable for engaging and retaining the weighted portion therein.

14. A dampening device for use with an archery bow, the dampening device absorbing vibrational energy which results from shooting an arrow from the bow, the dampening device comprising:

a housing, a resilient member, and a weighted portion;

the housing having an inside surface suitable for engaging and retaining the resilient member therein, the resilient member having an inside surface suitable for engaging and retaining the weighted portion therein wherein the weighted portion further comprises a hollow region, the hollow region containing a counteracting weight material, the counteracting weight material selected from at least one member of the group consisting of a fluid, particulate material and any combination thereof.

15. The dampening device of claim 14 wherein the particulate material is selected from at least one member of the group consisting of plastic, rubber, sand, lead, tungsten, steel, and alloys or any combinations thereof.

16. The dampening device of claim 14 wherein the fluid is selected from at least one member of the group consisting of water, oil, mercury and any combinations thereof.

17. The dampening device of claim 14 wherein the weighted portion further comprises a first half and a second half, the first half and the second half having a connecting means for removably connecting the first half and the second half together.

18. The dampening device of claim 17 wherein the connecting means comprises at least a potion of the first half and at least a portion of the second half which are opposingly threaded, and which may be threadingly connected to one another.

19. The dampening device of claim 17 wherein the first half is frictionally and removably engaged to the second half.

20. A dampening device for use with an archery bow, the dampening device absorbing vibrational energy which results from shooting an arrow from the bow, the dampening device comprising:

a housing and a dampening portion;

the housing comprising a portion of a bow having an inside surface suitable for engaging and retaining the dampening portion therein, the dampening portion having a weighted portion and a resilient portion, the weighted portion and the resilient portion constructed from the same material wherein the portion of the bow is selected from at least one member of the group consisting of a handle, an upper riser, a lower riser, an upper limb cup, a lower limb cup, an upper limb, a lower limb and any combinations thereof.

21. A combination archery bow and dampening device system for absorbing vibrational energy comprising:

an archery bow wherein the archery bow is a compound bow, a recurve bow or a cross-bow, the archery bow having one or more dampening devices, the one or more dampening devices having a housing and a resilient portion and a weighted portion, the housing having an outside surface, the outside surface having an attachment means for attaching the housing to the archery bow, the housing having an inside surface, the inside surface being removably engaged to at least a portion of the resilient portion, the resilient portion being removably engaged to at least a portion of the weighted portion, wherein the attachment means is comprised of a pair of elongate posts, each of the posts being received within a securement hole positioned in at least a portion of the archery bow.

22. The combination archery bow and dampening device system of claim 21 wherein each of the posts is retained on the bow by a fastener.

23. The combination archery bow and dampening device system of claim 22 wherein the posts and fasteners have opposingly threaded surfaces.

24. The combination archery bow and dampening device system of claim 21 wherein the weighted portion further comprises a hollow region, the hollow region containing a counteracting weight material, the counteracting weight material selected from at least one member of the group consisting of a fluid, particulate material and any combinations thereof.

25. The dampening device of claim 24 wherein the particulate material is selected from at least one member of the group consisting of plastic, rubber, sand, lead, tungsten, steel, and alloys or any combinations thereof.

26. The dampening device of claim 24 wherein the fluid is selected from at least one member of the group consisting of water, oil, mercury, and any combinations thereof.

27. A dampening device for use with an archery bow, the dampening device absorbing vibrational energy which results from shooting an arrow from the bow, the dampening device comprising:

a housing, and a dampening portion;

the housing comprising a portion of a bow having an inside surface suitable for engaging and retaining the dampening portion therein, the dampening portion having a hollow portion, the hollow portion having a predetermined volume, at least a portion of the predetermined volume containing a counteracting weight material, wherein the portion of the bow is selected from at least one member of the group consisting of a handle, an upper riser, a lower riser, an upper limb cup, a lower limb cup, an upper limb, a lower limb and any combination thereof.

28. A dampening device for use with an archery bow, the dampening device absorbing vibrational energy which results from shooting an arrow from the bow, the dampening device comprising a housing, the housing comprises a portion of a bow, the housing having a hollow portion, the hollow portion having a predetermined volume, at least a portion of the predetermined volume containing a counteracting weight material, wherein the portion of the bow is selected from at least one member of the group consisting of a handle, an upper riser, a lower riser, an upper limb cup, a lower limb cup, an upper limb, a lower limb and any combination thereof.

29. A dampening device for use with an archery bow, the dampening device absorbing vibrational energy which results from shooting an arrow from the bow, the dampening device comprising a dampening housing portion, the dampening housing portion composed of a resilient material and having an inside surface suitable for engaging and retaining a weighted portion and an outer surface suitable for attachment to an archery bow, wherein the dampening housing portion is elastic.

30. The dampening device of claim 29 wherein the dampening housing portion is constructed at least partially from rubber.

31. The dampening device of claim 29 wherein the outer surface of the dampening housing portion further comprises a means for attaching the housing to at least a portion of the bow.

32. The dampening device of claim 31 wherein the means for attachment to the bow is mechanical.

33. The dampening device of claim 31 wherein the means for attachment to the bow is made adhesively.

34. The dampening device of claim 29 wherein the outer surface of the dampening housing portion further comprises a means for attaching the dampening housing portion to at least a portion of a bow accessory.

35. The dampening device of claim 34 wherein the bow accessory is a sight.

36. The dampening device of claim 34 wherein the bow accessory is a stabilizer.

37. The dampening device of claim 29 wherein the weighted portion is made of a material selected from at least one member of the group consisting of brass, aluminum, lead, tungsten, steel, and alloys or any combinations thereof.

38. The dampening device of claim 29 wherein the weighted portion further comprises a hollow region, the hollow region containing a counteracting weight material, the counteracting weight material selected from at least one member of the group consisting of a fluid, particulate material and any combination thereof.

39. The dampening device of claim 38 wherein the particulate material is selected from at least one member of the group consisting of plastic, rubber, sand, lead, tungsten, steel, brass, and alloys or any combinations thereof.

40. The dampening device of claim 38 wherein the fluid is selected from at least one member of the group consisting of water, oil, mercury and any combination thereof.

41. The dampening device of claim 38 wherein the weighted portion further comprises a first half and a second half, the first half and the second half having a connecting means for removably connecting first half and the second half together.

42. The dampening device of claim 41 wherein the connecting means comprises at least a portion of the first half and at least a portion of the second half which are opposingly threaded, and which may be threadingly connected to one another.

43. The dampening device of claim 41 wherein the first half is frictionally and removably engaged to the second half.

* * * * *

UNITED STATES PATENT AND TRADEMARK OFFICE

CERTIFICATE OF CORRECTION

PATENT NO. : 6,382,201 B1
DATED : May 7, 2002
INVENTOR(S) : Mathew A. McPherson

It is certified that error appears in the above-identified patent and that said Letters Patent is hereby corrected as shown below:

Column 1,
Line 41, delete “modem” and insert -- modern --

Column 4,
Line 53, delete “fall” and insert -- full --;

Column 14,
Line 47, before the word “first” insert -- the --;

Signed and Sealed this

Twenty-seventh Day of August, 2002

*Attest:*

*Attesting Officer*

JAMES E. ROGAN
*Director of the United States Patent and Trademark Office*